United States Patent [19]

Rowinski

[11] 4,178,730

[45] Dec. 18, 1979

[54] DRY WALL REPAIR KIT

[76] Inventor: Anthony S. Rowinski, 2635 Rambling Way, Bloomfield Hills, Mich. 48013

[21] Appl. No.: 803,742

[22] Filed: Jun. 6, 1977

[51] Int. Cl.[2] ..... E02D 37/00; E04G 23/00

[52] U.S. Cl. ..... 52/514

[58] Field of Search ..... 52/514, 202, 509, 357, 52/358, 361, 362, 363

[56] References Cited

U.S. PATENT DOCUMENTS

| | | | |
|---|---|---|---|
| 1,879,457 | 9/1932 | Paulson | 52/714 |
| 2,281,519 | 4/1942 | Faber | 52/363 |
| 2,326,506 | 8/1943 | Tummins | 52/363 |
| 3,308,590 | 3/1967 | Ettore | 52/509 |
| 3,717,970 | 2/1973 | Rosenblum | 52/514 |
| 3,995,404 | 12/1976 | Thaw | 52/514 |

FOREIGN PATENT DOCUMENTS

| | | | |
|---|---|---|---|
| 852283 | 2/1955 | Norway | 52/548 |

*Primary Examiner*—James A. Leppink
*Assistant Examiner*—Henry E. Raduazo
*Attorney, Agent, or Firm*—Basile and Weintraub

[57] ABSTRACT

A device for facilitating the plugging of holes in dry wall or similar board-like structures includes an upstanding leg which defines a rear support surface and a board-penetrating member for staking the device in position. A plug is emplaced within the hold with the upstanding leg defining a stopped therefor.

5 Claims, 3 Drawing Figures

DRY WALL REPAIR KIT

BACKGROUND OF THE INVENTION

1. Field of the Invention

The present invention pertains to devices and methods for repairing structures. More particularly, the present invention pertains to means and methods for repairing dry wall and similar type structures. Even more particularly, the present invention pertains to means and methods for repairing and plugging holes formed in dry wall and other similar type structures.

2. Prior Art

It is well known that most residential structures, as well as many office structures, have the interior rooms thereof formed from dry wall of plaster board or such similar type structures. The use of lath and plaster, today, is virtually non-existent. Sheets of dry wall are placed against the joists and nailed in place. Thereafter, the sheets of dry wall are secured together with tape, in the well known manner.

The utilization and deployment of dry wall and similar type structure provides ease of use and advantages which need not be enumerated. However, one of the inherent draw backs in the utilization of dry wall is the ease with which it is damaged. The application of an extraordinary force applied thereto shatters and breaks the structure. Thus, accidental kicking, a missed hammer blow or the like results in damage to the wall structure which must be thereafter repaired.

As is well known to the skilled artisan, one of the more disconcerting difficulties encountered in utilizing dry wall is the repair thereof. This is especially true with large, gaping holes. Small holes do not provide any difficulty since these can be readily plugged with spackling compound or the like. However, this is not true with larger holes or apertures. Larger holes or apertures must be plugged with something which approximates the dry wall or a dry wall plug, per se. Yet, there is no easy mode by which such plugs can be readily installed. There is no backing surface against which a plug can abut. Ordinarily, the frustrations encountered include the plug dropping into the hollow behind the dry wall or the misalignment of the plug.

Applicant is unaware of any truly relevant prior art which affords a simple and convenient mode whereby holes in dry wall can be readily plugged. As will subsequently be detailed, the present invention affords a simple and convenient mode whereby holes in dry wall of any substantial dimension can be readily and easily repaired.

SUMMARY OF THE INVENTION

In accordance with the present invention, there is provided a means and method for repairing holes in dry wall. The present invention contemplates a device which defines a stop which protrudes into the aperture and which is coplanar with the rear surface of the dry wall. By protruding into the area of the aperture a means is provided for limiting the placement of a plug or the like. Thus, in accordance herewith, any plug is rendered contiguous with the planes of the rear and front surfaces of the dry wall sought to be repaired.

The device hereof further comprises means for placing the device within the dry wall composition. The means, preferably, comprises a point or similar member which penetrates the dry wall composition.

In accordance with the present invention, a hole or similar opening in dry wall is readily repaired by inserting about the periphery of the hole a plurality of the devices hereof. Thereafter, a plug or similar repair mechanism is inserted into the hole. Then, the plug is fixed in position such as by taping or the like.

For a more complete understanding of the present invention, reference is made to the following detailed description and accompanying drawing. In the drawing, like reference characters refer to like parts throughout the several views in which:

DESCRIPTION OF THE PREFERRED EMBODIMENT

Figure 1:
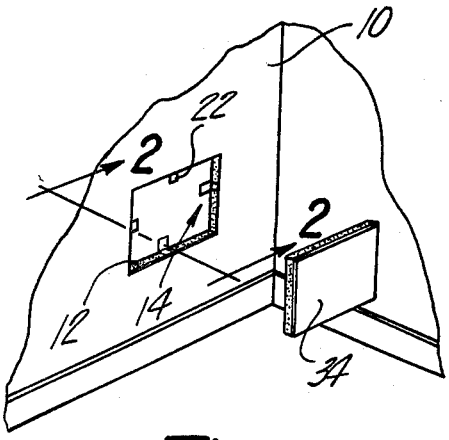
FIG. 1 is a perspective, exploded view showing the utilization and deployment of the device of the present invention.

At the outset, it is to be noted that as utilized within the context of the present application and the amended claims, the term "dry wall" refers to that material of construction which ordinarily comprises a laminated structure of paper, a filler composition, and an outer layer of paper. This structure being formed to certain dimensions which ordinarily range from ½ inch to ⅝ inch. The filler composition is usually plaster admixed with other fillers such as asbestos or the like. It is to be understood that as contemplated herewithin, the present invention is applicable to such type of "dry wall" structues which are commonly referred to as dry wall, plaster board or the like. The present invention has equal efficacy with any such structure.

Now, and with reference to the drawing, there is depicted therein a section of dry wall 10 having an aperture 12 formed therethrough. It is to be understood that the mode by which the aperture is formed, as well as the dry wall composition, do not form part of the instant invention.

In order to effectuate repair of the aperture 12, there is deployed a device in accordance with the present invention and, generally, denoted at 14.

The device 14 comprises a first elongated leg 16, a second leg 18 which radiates from the first leg and is substantially perpendicular thereto. Downwardly depending from the free end of the second leg is a penetrating means or member 20.

The elongated leg 16 is adapted to abut the rear surface of the dry wall and projects into and traverses the area defined by the aperture 12. Thus, that portion of the leg which interrupts the area of the aperture defines a stop, generally denoted at 22. The leg 18 which projects outwardly from the leg 16 is substantially perpendicular thereto. The leg has a length slightly less than that of the dry wall to be repaired. The leg 18 also defines a limiting means for limiting the degree of penetration of the penetrating means 20.

Figure 3:
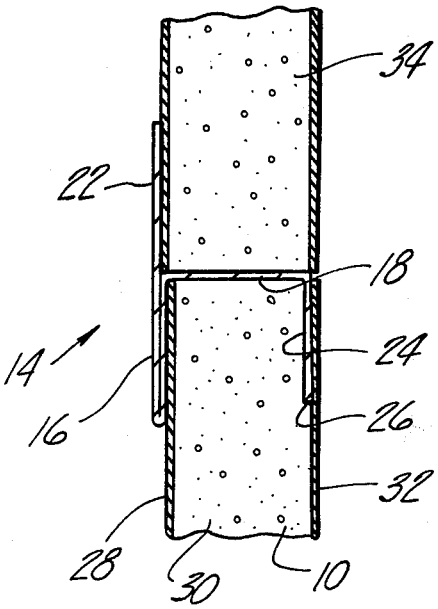
FIG. 3 is a cross-sectional view of the device, emplaced in a section of dry wall, with a repair plug being associated therewith, the view being taken along the line 3—3 of FIG. 1.

As clearly shown in FIG. 3, when the device 14 is emplaced the leg 18 seats atop the perimeter wall of the hole to be repaired.

The penetrating means 20 depends from the free end of the leg 18 and is, preferably, substantially perpendicular thereto.

The penetrating means 20 generally comprises a triangular configured member 24. The member 24 terminates in a point 26. Because of the fabrication of the dry wall 10, per se, the penetrating member easily penetrates the dry wall composition to fixedly emplace the device in position.

In practicing the present invention, the leg 18 is dimensioned such that it has a length less than that of the width of the dry wall to be repaired. In this manner the penetrating means penetrates the dry wall either directly into the plaster composition or, alternatively, penetrates the dry wall at the interface of the dry wall and the front paper.

More specifically, and as clearly shown in FIG. 3, it will be seen that the dry wall 10 comprises a rear paper surface 28, a central plaster section 30 and a front paper surface 32. When the device 14 is emplaced in position, a portion of the extended leg 16 abuts the rear surface paper, the leg 18 extends the width of the dry wall and the penetrating means penetrates either into the dry wall composition or penetrates the dry wall at the interface referred to above.

In repairing dry wall in accordance with the present invention, the aperture 12, is preferably, formed to a regular geometric form, such as a square, circle or the like. At least one of the devices 14 is then placed in position with the stop means 22 traversing the hole. It will be noted in this regard that the stop means 22 is substantially coplanar with the rear paper surface of the dry wall to effectuate a smooth and even repair.

After the device 14 is placed in position a plug or similar member 34 is then placed in the opening or hole 12. Because the device incorporates and comprises the stop means, the plug cannot pass through the hole and fall through the hollow therebehind. Next, the plug is adhered in position with glue, patching plaster, tape or similar adhesive means.

The tape, if used, covers up any bulge in the dry wall which might be present if the penetrating means is disposed at the interface. Under such conditions, a bulge in the paper may be formed. However, the tape obviates this. Usually, in repairing dry wall, after the tape is in position, the surfaces are then sanded to eliminate any ridges. The tape and the surfaces are, then painted.

Furthermore, the perimeter of the aperture as well as the plug may be coated with patching plaster to promote adhesion between the plug and the wall structure to be repaired.

It will be appreciated from the preceding that the present device accords and enables a simple, effective and efficient mode of repairing a hole in dry wall.

Figure 2:
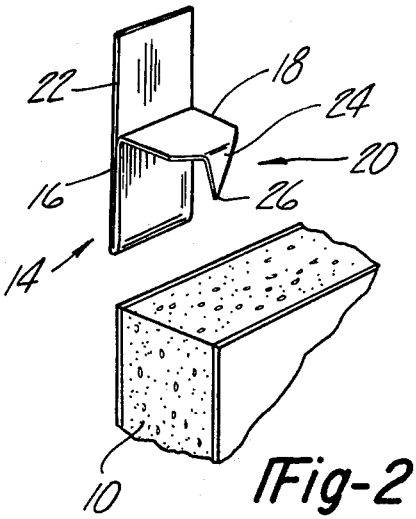
FIG. 2 is an exploded, perspective view of a device in accordance with the present invention, and its association with a section of dry wall.

In forming the device hereof, it is preferred that it be formed as a unitary member. Thus, the extended leg 12 is integrally formed with the leg 18 and the penetrating means 20. In stamping the device out of metal ordinarily the extended leg includes a folded over or overlying short leg section which then has a right angle bend formed therein which defines the leg 18. This is particularly shown in FIGS. 2 and 3. However, the overlapping or overlying leg is present solely as a result of the method of manufacture utilized, and is not of critical importance to the practice of the present invention.

It will be readily apparent from the preceding that there has been described herein a simple and effective mode of repairing dry wall and similar type wall structure utilizing the device hereof.

Having, thus, described the invention, what is claimed is:

1. In a drywall repair device which is inserted into the periphery of a drywall, having paper and plaster sections, about an opening formed in the drywall for enabling a repair plug to be inserted into the opening, the improvement comprising:

(a) an extended linear first leg having a first portion abutting the drywall at the rear of the opening and a second portion, continuous with the first portion which projects into the opening formed in the drywall, the second portion defining stop means for limiting the degree of insertion of a repair plug into the opening, (b) a second leg projecting from the first leg spanning the width of the drywall, the second leg having a length less than the width of the drywall, and (c) drywall penetrating means depending from the second leg which are inserted into the drywall between the paper and plaster sections, about the opening for fixing the device in position, and wherein the first portion cooperates with the second leg and penetrating means to define the sole means by which the device is supported on the drywall.

2. The improvement of claim 1 wherein:

the penetrating means comprises a pointed triangular member, the base of which is integral with the second leg.

3. The improvement device of claim 1 wherein:

the second leg is substantially perpendicular to the first leg.

4. The improvement device of claim 1 wherein:

the penetrating means is parallel to the extended leg.

5. A method for effecting the repair of holes in drywall with a drywall repair device and a drywall repair plug comprising the steps of:

(a) sizing the hole in the drywall to form an opening conforming to predetermined dimensions;

(b) selecting a drywall repair plug having dimensions conforming to those of the opening;

(c) inserting into the opening at least one drywall repair device having an extended linear first leg having a first portion adapted to abut against the drywall at the rear of the opening and a second portion, continuous with the first portion which traverses the opening, defining stop means substantially co-planar with a rear surface of the drywall; a second leg projecting from the first leg spanning the width of the drywall, the second leg having a length less than the width of the drywall, and drywall penetrating means depending from the second leg;

(d) driving the penetrating means into the drywall about the sized hole such that the penetrating means is inserted into the drywall between the paper and the plaster;

(f) emplacing the drywall plug in the opening, the plug abutting the stop means, and (g) securing the plug in position by adhesive means.

* * * * *